US008083103B2

(12) United States Patent
LaFlamme et al.

(10) Patent No.: US 8,083,103 B2
(45) Date of Patent: Dec. 27, 2011

(54) DISPENSER WITH DUAL PUMP SYSTEM

(75) Inventors: Roger J. LaFlamme, Enfield, CT (US); Robert J. Mileti, Torrington, CT (US)

(73) Assignee: Sealed Air Corporation (US), Elmwood Park, NJ (US)

( * ) Notice: Subject to any disclaimer, the term of this patent is extended or adjusted under 35 U.S.C. 154(b) by 416 days.

(21) Appl. No.: 12/046,677

(22) Filed: Mar. 12, 2008

(65) Prior Publication Data

US 2008/0223875 A1 Sep. 18, 2008

Related U.S. Application Data

(60) Provisional application No. 60/894,722, filed on Mar. 14, 2007.

(51) Int. Cl.
*B67D 7/70* (2010.01)

(52) U.S. Cl. .... 222/135; 222/94; 222/145.1; 222/145.5; 222/207; 222/631; 222/633

(58) Field of Classification Search ..... 222/94–95, 222/135, 136, 145.1, 145.5, 209, 206–207, 222/212–215, 630–633, 491, 494, 372–373, 222/383.1, 385

See application file for complete search history.

(56) References Cited

U.S. PATENT DOCUMENTS

| | | | | |
|---|---|---|---|---|
| 886,984 | A | 5/1908 | Jopling | |
| 1,217,054 | A | 2/1917 | Pearman | |
| 1,754,078 | A * | 4/1930 | Borzi | 222/135 |
| 1,941,745 | A | 1/1934 | Higley | |
| 2,714,475 | A | 8/1955 | Roehrich | |
| 2,855,127 | A | 10/1958 | Lerner et al. | |
| 3,223,289 | A | 12/1965 | Bouet | |
| 3,396,419 | A | 8/1968 | Richter et al. | |
| 3,617,139 | A | 11/1971 | Ross | |
| 3,949,137 | A | 4/1976 | Akrongold et al. | |

(Continued)

FOREIGN PATENT DOCUMENTS

| | | |
|---|---|---|
| DE | 4030851 | 4/1992 |

(Continued)

OTHER PUBLICATIONS

Stephen & Lawyer, Inc., Reticulated Foam, http://www.steplaw.com/reticulatedfoam.html.

(Continued)

*Primary Examiner* — Frederick C. Nicolas

(74) *Attorney, Agent, or Firm* — St. Onge Steward Johnston & Reens

(57) ABSTRACT

A fluid dispenser is provided that includes a multiple chamber fluid storage region, each having a dispensing pump of its own such that the dispenser can dispense the fluids from within the multiple fluid storage regions. Further, the multiple fluid storage regions may each contain the same or different liquids. The dispensing pumps include a metering housing, which when depressed, generate a one-way flow from the interior fluid storage region of the container that serves to fill the predetermined volume of the chamber within the metering housing. When the metering housing is depressed a second time a substantially equal volume of each of the fluids is dispensed from the container, while upon release, the metering housings are refilled by drawing fluids from their respective fluid storage regions. The fluids are mixed in the exit port as they are dispensed from the metering pumps.

26 Claims, 3 Drawing Sheets

U.S. PATENT DOCUMENTS 3,981,106 A 9/1976 Gallo
4,004,854 A 1/1977 Breer, II
4,074,944 A 2/1978 Xavier
4,098,434 A 7/1978 Uhlig
4,124,316 A 11/1978 O'Rourke
4,127,515 A 11/1978 MacRae et al.
4,188,989 A 2/1980 Andersen
4,274,556 A * 6/1981 Thiessen ..... 222/135
4,702,397 A 10/1987 Gortz
4,753,006 A 6/1988 Howe
4,760,642 A 8/1988 Kwak
4,809,432 A 3/1989 Schauble
4,830,226 A * 5/1989 Kong ..... 222/205
4,886,388 A 12/1989 Gulker et al.
4,888,868 A 12/1989 Pritchard
4,889,441 A 12/1989 Tice
4,890,744 A 1/1990 Lane, Jr. et al.
4,993,594 A 2/1991 Becker et al.
5,014,427 A 5/1991 Byrne
5,016,351 A 5/1991 Drahus
5,074,765 A 12/1991 Pekar
5,114,255 A 5/1992 Villarreal
5,168,628 A 12/1992 Mock et al.
5,176,510 A 1/1993 Nilsson
5,261,570 A 11/1993 Hippely et al.
5,265,772 A 11/1993 Bartasevich et al.
5,303,851 A 4/1994 Libit et al.
5,337,478 A 8/1994 Cohen et al.
5,353,961 A 10/1994 Debush
5,356,039 A 10/1994 Christine et al.
5,372,487 A 12/1994 Pekar
5,387,207 A 2/1995 Dyer et al.
5,441,345 A 8/1995 Garvey et al.
5,482,980 A 1/1996 Pcolinsky
5,505,341 A 4/1996 Gueret
5,555,673 A 9/1996 Smith
5,564,190 A 10/1996 Fleetwood
5,640,737 A 6/1997 Boggs
5,697,526 A * 12/1997 Lee ..... 222/113
5,700,245 A 12/1997 Sancoff et al.
5,701,674 A 12/1997 Mitchell
5,704,723 A 1/1998 Salisian
5,761,813 A 6/1998 Frick et al.
5,769,585 A * 6/1998 Podolsky ..... 401/146
5,836,482 A 11/1998 Ophardt et al.
5,842,607 A 12/1998 Snider
5,855,066 A 1/1999 Manager
5,865,554 A 2/1999 Lin
5,934,296 A 8/1999 Clay
5,944,032 A 8/1999 Masterson
5,950,928 A 9/1999 Giang et al.
5,983,500 A 11/1999 da Silva
6,012,611 A * 1/2000 Schroeder ..... 222/105
6,183,154 B1 2/2001 Coe
6,210,064 B1 4/2001 White et al.
6,251,098 B1 6/2001 Rake et al.
6,302,607 B1 10/2001 Burrowes et al.
6,394,316 B1 5/2002 Daansen
6,406,207 B1 6/2002 Wiegner et al.
6,412,660 B1 * 7/2002 Bouix et al. ..... 222/94
6,419,118 B1 7/2002 Rees et al.
6,558,629 B1 5/2003 Davidson
6,623,201 B2 9/2003 Brumlik
6,629,799 B2 10/2003 Flores, Jr.
6,641,307 B2 11/2003 Matsuda et al.
6,715,952 B1 4/2004 Aiken et al.
6,754,958 B2 6/2004 Haws et al.
6,789,321 B2 9/2004 Simms
6,789,706 B2 9/2004 Abergel et al.
6,834,778 B2 * 12/2004 Jinbo et al. ..... 222/135
6,843,368 B1 1/2005 Frutin
6,868,987 B2 * 3/2005 Hedington et al. ..... 222/95
6,883,563 B2 4/2005 Smith
6,886,254 B1 5/2005 Pennella
6,910,274 B1 6/2005 Pennella et al.
6,925,716 B2 8/2005 Bressler et al.
6,929,155 B1 8/2005 Sayers
6,964,097 B2 11/2005 Franzini et al.
6,996,908 B2 2/2006 Orloff et al.
7,043,841 B2 5/2006 Franzini et al.
7,121,754 B2 10/2006 Bressler et al.
7,137,203 B2 11/2006 Bressler et al.
7,137,531 B2 11/2006 Arghyris et al.
7,156,132 B2 1/2007 O'Dougherty et al.
7,159,742 B2 1/2007 Lee
7,562,796 B2 * 7/2009 Zahn et al. ..... 222/541.9
2001/0025859 A1 10/2001 Dumont
2001/0025860 A1 10/2001 Auer
2002/0085873 A1 7/2002 Katsandres et al.
2003/0077106 A1 4/2003 Weihrauch
2003/0121936 A1 7/2003 De Laforcade
2004/0092864 A1 5/2004 Boehm, Jr. et al.
2004/0140326 A1 7/2004 Smart et al.
2004/0177510 A1 9/2004 Pennella
2004/0178284 A1 9/2004 Fahy et al.
2005/0138814 A1 6/2005 Pennella et al.
2005/0144785 A1 7/2005 Bressler et al.
2005/0199651 A1 9/2005 Laflamme et al.
2006/0072858 A1 4/2006 Kurosawa et al.
2006/0150386 A1 7/2006 Wanli et al.
2006/0163282 A1 * 7/2006 Suzuki ..... 222/135
2006/0186140 A1 * 8/2006 Kanfer et al. ..... 222/207
2006/0249536 A1 * 11/2006 Hartman et al. ..... 222/129.3
2006/0254056 A1 11/2006 Coffin et al.
2006/0255068 A1 11/2006 Genosar
2006/0272154 A1 12/2006 Brevard
2007/0017098 A1 1/2007 Bressler et al.
2007/0068966 A1 * 3/2007 Orzech et al. ..... 222/136
2007/0084058 A1 4/2007 Szczepanowski et al.
2007/0214646 A1 9/2007 Bezdek
2008/0277419 A1 * 11/2008 Holcomb et al. ..... 222/129
2009/0308890 A1 * 12/2009 Saravis ..... 222/135

FOREIGN PATENT DOCUMENTS

DE 29719331 12/1997
DE 29818058 1/1999
FR 2628394 A1 9/1989
FR 2683759 11/1991
GB 2083142 A 3/1982
JP 6293348 10/1994
JP 10165668 6/1998
JP 2005199020 7/2005
WO 0176972 A1 10/2001
WO 0176974 A1 10/2001
WO 02071907 A1 9/2002
WO 2004096504 11/2004
WO 2005086852 A2 9/2005

OTHER PUBLICATIONS

3M Worldwide, Scotch-Brite Urethane Laminate 325HK 5 Pieces/Pack 72 Packs/Case, http://products3.3m.com/catalog/hk/en009/home_leisure/–/node_H16XQM6PDVgs/root_B . . . .

Plastic Bags for You, Pouch (zipper & non zipper), flat pouch, stand up pouch, with and without valve, with and without window, plain & preprinted, paper bag, etc., http://plasticbagsforyou.com/PRODUCTS/pouch-group.html.

* cited by examiner

DISPENSER WITH DUAL PUMP SYSTEM

CROSS-REFERENCE TO RELATED APPLICATIONS

This application is related to and claims priority from earlier filed U.S. Provisional Patent Application No. 60/894,722 filed Mar. 14, 2007.

BACKGROUND OF THE INVENTION

This invention relates generally to product packages that include integrated dispensing devices. More specifically, the present invention relates to product packages containing fluid media that include metering dispensing devices that can controllably dispense the fluid media from the product package containing the fluid media.

Various types of fluid material and media are employed for different purposes throughout commerce and industry. For example, there are various products in the areas of personal care, home care, air care, transportation care and food industries that require a fluid material to be dispensed in some manner from a source of such material. Further, when this material is sold in commerce, it must be contained and stored in some type of container while awaiting use. Ultimately, when that product is used, it must be dispensed from its storage container to the desired location for use.

In the prior art, there are many different types of dispensers that are employed for the delivery of a stored fluid material to their desired location for use. For example, a storage container having a flexible body with a nozzle tip extending therefrom is commonly provided for such a purpose. An example of such use can be seen in the context of a ketchup dispenser, where a user squeezes the container body to urge the fluid material (ketchup) out from container body and through the nozzle tip to accurately deposit the fluid material at the desired location. In such an application, the amount of fluid that is ultimately delivered is determined by the how much the user actually squeezes the container body. While this method has provided marginally acceptable results, this method also typically yields an erratic fluid volume since more or less fluid material may be delivered on each successive squeeze of the container body. Also, the container must be held upright to avoid leakage because no valves are employed in the fluid nozzle tip.

In another example of a prior art dispensing device, a flexible container is provided that holds a volume of fluid material to be delivered. In an attempt to overcome the leakage issue noted above, a single one-way check valve is provided at the exit port of the flexible container. When the flexible body is squeezed, the material is urged out under pressure through the valve. The difficulty here is that the valve over time becomes partially clogged thereby requiring that the user apply additional pressure to cause the valve to open. As a result, once the valve opens, the additional pressure causes more fluid material to be deposited than the user typically would have desired.

In addition to the above noted need for simply dispensing a volume of fluid material, there is also a desire for the ability to immediately apply the dispensed fluid material, such as to a surface. In the prior art, the solution was to provide squeezable container bodies that are equipped with some type of applicator head for this purpose. For example, in the personal care industry, body wash devices commonly include some type of squeezable container body and an abrasive applicator material, such as fabric or foam, applied to the output port thereof. Thus, when the fluid material is dispensed to the exterior of the container body, it is dispensed onto the applicator and the applicator assists in spreading the material on the body of the user providing a better and more even distribution thereof. Applicators are particularly useful for even distribution in personal care industry, such as for applying shoe polish, to ensure a quality even and smooth coat.

In addition to the provision of applicator disposed at the outlet of the container, there have been attempts in the prior art to provide a dispenser that can easily deliver fluid material to an applicator that is positioned about the entire exterior surface of a container body. These prior art devices employ, for example, spring-loaded buttons that open an exit port in the main container body to permit flow of the fluid contained therein to an outer applicator material layer. This is in contrast to requiring the user to squeeze the entire body of the container. However, these devices are incapable of delivering a substantially equal dose of fluid with each dispensing operation because they simply open up the container body and permit the fluid to flow into the surrounding applicator material by gravity.

There is also a generally a need for a fluid dispensing device that includes the ability to increase the amount of fluid dispensed on each pump, such as doubling the amount of liquid dispensed on each pump. Also in this regard, there is a need to store two or more liquids separately while providing a single dispensing unit that dispenses and mixes them together in a dingle dispensing operation. For example, two different types of hair care liquids can be dispensed at the same time in a metered dose by a single pump. It is also desirable to provide a dispenser that allows a user to select whether a single or double pump is used to dispense the fluid while also controlling the amount of fluid dispensed from each of the fluid sources.

In view of the foregoing, the fluid dispensing devices of the prior art suffer from various disadvantages that make them difficult and awkward to use. Further, these prior art dispensers often provide a user with unexpected results. Therefore, there is a need for a fluid dispenser that is easy to operate. There is a further need for a fluid dispenser that is capable of delivering a metered dose of fluid with each dispensing operation in order to produce predictable flow and a better application of the fluid material. There is also a need for such a dispenser that can operate independent of gravity. There is an additional need for the fluid to be capable of being delivered in a manner that allows the fluid to exit at any point on the surface of container. There is still a further need for a dispenser to include an applicator that facilitates even distribution and even application of the fluid material, as desired. Many of these needs are met by commonly owned, co-pending U.S. patent application Ser. No. 11/074,817, filed on Mar. 8, 2005 and U.S. patent application Ser. No. 11/951,351, filed on Dec. 6, 2007, which are incorporated herein by reference. This application sets forth a device for dispensing liquids in a metered fashion and provides for an exit port that can be located at any position on the fluid container. However there is still a further need for a dispenser that has multiple chambers, each with their own respective valving to independently control the flow and dispensing of fluid therefrom.

BRIEF SUMMARY OF THE INVENTION

In this regard, the present invention preserves the advantages of prior art dispensing devices. In addition, the present invention provides new advantages not found in currently available devices and overcomes many disadvantages of such currently available devices. The present invention is generally directed to a novel and unique multiple chambered dispenser device for delivering a controlled, metered dose of fluid material from each of the multiple chambers during each dispensing operation. In this regard, the multiple chambers may contain different fluids or may all contain the same fluid thereby allowing a dispensing operation that can be varied in volume, should the fluids be the same, or a mixing operation, should the fluids be different.

The main flexible pouch and metering mechanism employed within the present invention is substantially similar to that found in the above noted U.S. patent application Ser. Nos. 11/074,817 and 11/951,351. The fluid dispensing device includes a container with multiple interior fluid storage regions therein. Each storage region also includes its own metering housing, having a preferably flexible construction that is disposed in fluid communication with the respective fluid storage region. A first one-way valve is disposed between the fluid storage region and the flexible metering housing. When the flexible metering housing is depressed and released a vacuum action generates a one-way flow from the interior fluid storage region of the container that serves to fill the predetermined volume of the chamber within the metering housing. A second valve, in fluid communication with the metering housing output port, permits one-way fluid flow from the metering chamber to the exterior outer region of the container when the metering housing is depressed again. Each time the metering housing is depressed a substantially equal volume of fluid is dispensed from the container, while upon release, the metering housing is refilled by drawing fluid from the fluid storage region.

As stated above, the present invention further includes a multiple chamber fluid storage region, each having a dispensing pump of its own such that the dispenser can simultaneously dispense the fluid within the multiple fluid storage regions. Further, in such an arrangement, the multiple fluid storage regions may each contain the same or different liquids. Also, the dosing and the volumes of the pumps on each of the respective chambers can be adjusted to the suit the liquid being dispensed and the desired mixing thereof.

It is therefore an object of the present invention to provide fluid dispensing device including multiple fluid storage regions therein that can deliver a controlled, metered volume of fluid material with each dispensing operation. It is also an object of the present invention to provide such a fluid dispensing device that is insensitive to gravity. It is yet another object of the present invention to provide a multiple chamber, such as a dual chamber, dispenser that has multiple fluid storage regions that contain the same or different fluid for dispensing wherein the dispensing operation can be varied in volume, should the fluids be the same, or provides a mixing operation, should the fluids be different.

These together with other objects of the invention, along with various features of novelty that characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

BRIEF DESCRIPTION OF THE DRAWINGS

In the drawings which illustrate the best mode presently contemplated for carrying out the present invention.

DETAILED DESCRIPTION OF THE INVENTION

Figure 3:
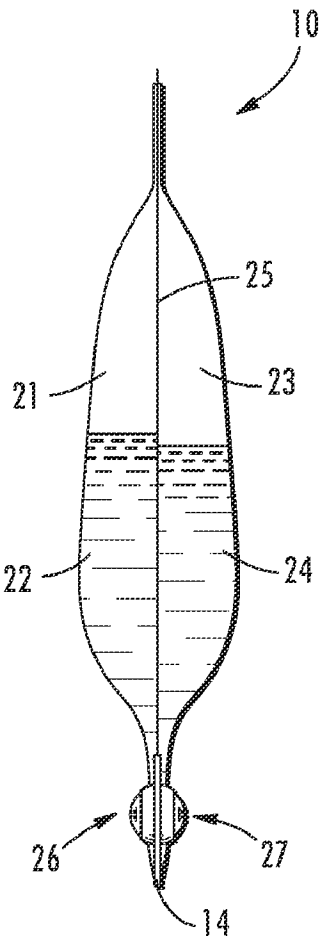
FIG. 3 is a cross sectional view of the dispensing device of the present invention taken along line 3-3 of FIG. 2.
Figure 2:
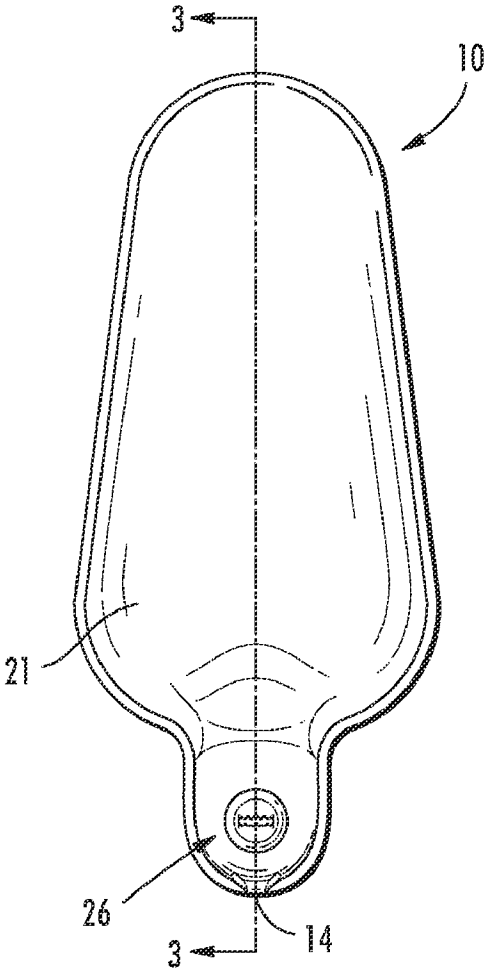
FIG. 2 is a front view thereof.
Figure 1:
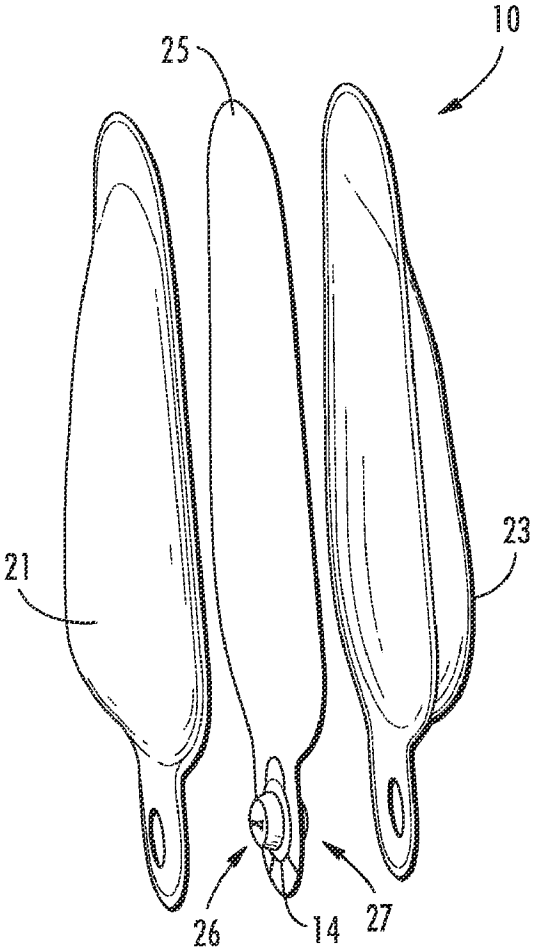
FIG. 1 is an exploded perspective view of a dual reservoir dispensing device of the present invention.

Now referring to the drawings, the dispensing device of the present invention is shown and generally illustrated at 10 in FIGS. 1-3. As can be seen, the dispensing device 10 of the present invention includes a first fluid reservoir 21 containing a first fluid 22, a second fluid reservoir 23 containing a second fluid 24. A first metered dosing pump 26 is provided in fluid communication with the first fluid reservoir 21 and is operable to transfer a portion of the first fluid 22 from the first fluid reservoir 21 to an output port 14. A second metered dosing pump 27 is provided in fluid communication with the second fluid reservoir 23 and is also operable to transfer a portion of the second fluid 24 from the second fluid reservoir 23 to the output port 14. It should be appreciated that generally, while the dispensing device 10 of the present invention is depicted as having a first fluid reservoir 21 and a second fluid reservoir 23, it is within the scope of the present invention that the device include a plurality of fluid reservoirs as needed by any given application. While for the remainder of the present application, the dispensing device 10 will be discussed in the context of a first fluid reservoir 21 and a second fluid reservoir 23, it is intended that a plurality of fluid reservoirs is equally disclosed. It is also within the scope of the present invention that, should a plurality of fluid reservoirs be provided, a corresponding plurality of metered dosing pumps will be provided, one in fluid communication with each of the fluid storage reservoirs.

In the context of the present invention, the fluid dispensing device 10 is suitable for use in connection with any application that requires two or more different fluids be stored separately prior to their use by the consumer, as in the case for example of, two-part epoxy adhesives, hair colorant systems or hair conditioning systems. In such an arrangement, the fluids are mixed together as they pass down the output port 14. It is also within the scope of the present invention that all of the fluid reservoirs contain the same fluid. In this arrangement, the provision of multiple fluid storage reservoirs and multiple metered pumps provides a user with the ability too control the overall amount of fluid dispensed with each dispensing action. Still further, while multiple fluid storage reservoirs are provided, they may be provided in an integral outer shell wherein the divisions between each of the reservoirs is a frangible seal that the user can optionally rupture to allow the fluids contained within the separated reservoirs to be mixed prior to use. While specific examples have been provided herein, they are meant for illustration and are not intended to be limiting on the scope of the present invention.

Turning now to FIGS. 1-3 in detail, the first fluid reservoir 21 can be seen to have an outer wall that cooperates with one side of a central wall 25 to form an interior cavity that serves as the first fluid reservoir 21 and contains a first fluid 22 therein. Similarly, the second fluid reservoir 23 also has an outer wall that cooperates with an opposing side of the central wall 25 to form an interior cavity that serves as the second fluid reservoir 23 and contains a second fluid 24 therein. A first metered dosing pump 26 is positioned in the first fluid reservoir 21 and is in fluid communication with the first fluid 22 contained therein. A second metered dosing pump 27 is positioned in the second fluid reservoir 23 and is in fluid communication with the second fluid 24 contained therein. The respective outputs 28 of the first and second fluid pumps 26, 27 in this embodiment are arranged in parallel to simultaneously deposit the first and second fluids 22, 24 into the output port 14.

Figure 4:
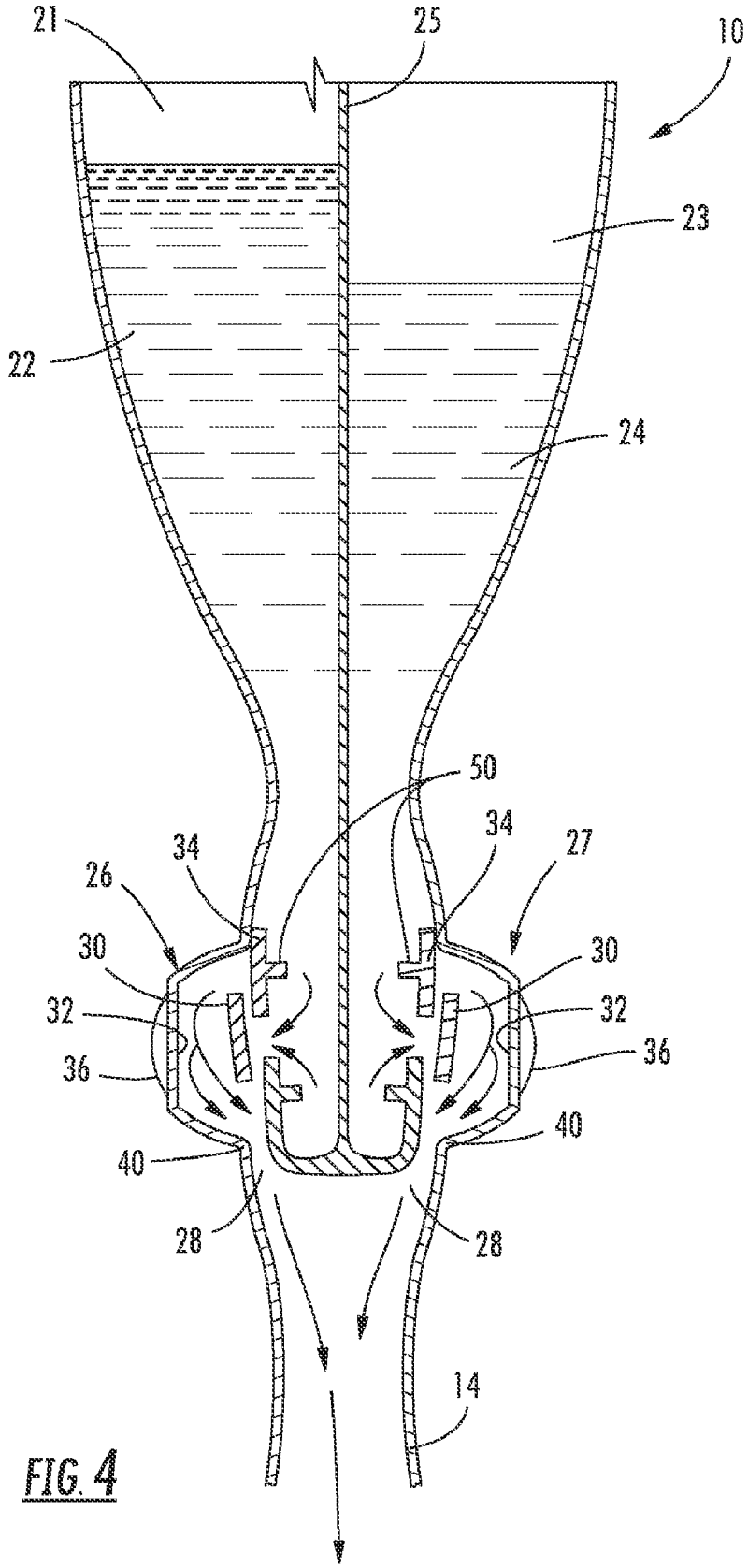
FIG. 4 is a cross-sectional view of the preferred metered dosing pump used in connection with the present invention.

FIGS. 3 and 4 in particular depict a cross-sectional view through the first and second metering pumps 26, 27 along the line 3-3 of FIG. 2, where FIG. 4 is a close in view shown to illustrate the internal construction of the metering pumps 26, 27 used in connection with the fluid dispenser 10 of the present invention. While disposed in a back-to-back relation, the first and second metering pumps 26, 27 are otherwise constructed identically in terms of structure and therefore the matching features will be called out with matching reference numerals. It should be appreciated however that the first and second metering pumps 26, 27 may vary in size, profile, operational pressure, recess, etc. while including the same structural elements. As was stated above, the first and second fluid reservoirs 21, 23 are provided to include first and second fluid storage regions that each contains a volume of first and second fluid material 22, 24 respectively therein. The outer walls of the first and second fluid reservoirs 21, 23 are preferably made of a flexible material, such as plastic or nylon. Thus, as the first and second fluid material 22, 24 is evacuated from within the first and second fluid reservoirs 21, 23, they will collapse gradually for a compact structure.

Metering housings are provided at the first and second metering pumps 26, 27. The metering housings include an intake one-way valve 30, such as a check valve, to pull fluid 22, 24 from the fluid storage regions into a metering chamber 32 of a predetermined size. Any type of valve can be used to suit the given application. The intake valve 30 is positioned in a base plate 34 of the metering housing. Thus, during intentional operation, fluid 22, 24 can only flow in one way from the fluid storage regions 21, 23 into the metering chamber 32 although it is possible that the valve allow two way travel of fluid for a portion of the stoke to prevent accidental dispense. The metering chamber 32 is defined by a flexible membrane 36 in the form of a button or bulb that is accessible and manipulateable such that the user can depress both flexible membranes 36 simultaneously. The button 36 is preferably clear to provide an indicator to the consumer when the metered dosage of fluid material 22, 24 is ready for delivery. Further, it is preferred that the two metering pumps 26, 27 are positioned adjacent one another so that the user can press both metering pumps 26, 27 simultaneously although any other suitable arrangement would also be within the scope of the invention such as providing a nested set of pumps or a stacked set of pumps.

An output valve 40 is provided in fluid communication with the metering chamber 32 of the metering housing. Thus, the fluid residing in the metering chamber 32 can only exit through the output valve 40 into the mixing chamber 14 that serves to direct the exit of the fluids 22, 24. In this particular case to the interior of the outlet port 14.

In accordance with the present invention, each press of the flexible membrane 36 causes a metered amount of first and second fluid 22, 24 to be forced into the mixing chamber 14. It should be appreciated that the button/membrane 36 can be placed anywhere on the device 10, as needed. Still referring to FIG. 3, the operation of the metered dosing pumps 26, 27 are further explained. The button 36 of the metering housing is depressed to initiate a vacuum operation. More specifically, when the button 36 is further released, first and second fluid 22, 24 is pulled from the first and second fluid reservoirs 21, 23 into the metering chamber 32 which is configured to be of a certain known volume. The act of releasing the button 36 fills the metering chamber 32 to substantial capacity. Thus, a metered amount of fluid material 22, 24 is contained within the metering chamber 32 in preparation for delivery. The size of the metering chamber 32 can be selected according to the type of fluid material 22, 24 to be dispensed, the application therefor and the desired dosage volume. The volumes may be matched or different as required by the particular application at hand. A further depression of the button 36 urges the measured volume of fluid 22, 24 within the metering chamber 32 to exit out through the output port 14 of the metering housing. This known amount of fluid material 22, 24 is then routed into the output port 14. This allows in most cases for the first and second fluids 22, 24 to be mixed before dispensing. In the case of a hair colorant system for example, dye and the colorant are deposited directly into the output port 14 and thoroughly mixed before dispensing. Alternately, if the same fluid is provided in the first and second fluid reservoirs 21, 23 then the user can selectively press one or both of the buttons 36 to control the amount of fluid dispensed.

It can also be seen in FIG. 4 that a number of standoff legs 50 emanate downwardly from the base plate 34 of the metering housing. These legs 50 prevent the base plate 34 from completely bottoming out against the fluid reservoir 21, 23 wall thereby blocking flow of fluid material 22, 24 into the intake valve 30. The standoff legs 50 are particularly useful when the volume of fluid material 22, 24 left in the fluid reservoir 21, 23 is running low and the fluid reservoir 21, 23 is becoming relative flat in configuration. In this situation, there is a possibility that the aforesaid bottoming out may occur. However, the use of the standoff legs 50 prevents this from occurring. It should also be appreciated that while standoff legs 50 are shown, other spring biased or spring like structures may be used to accomplish the same function and should be considered interchangeable with the standoff legs 50.

Figure 5:
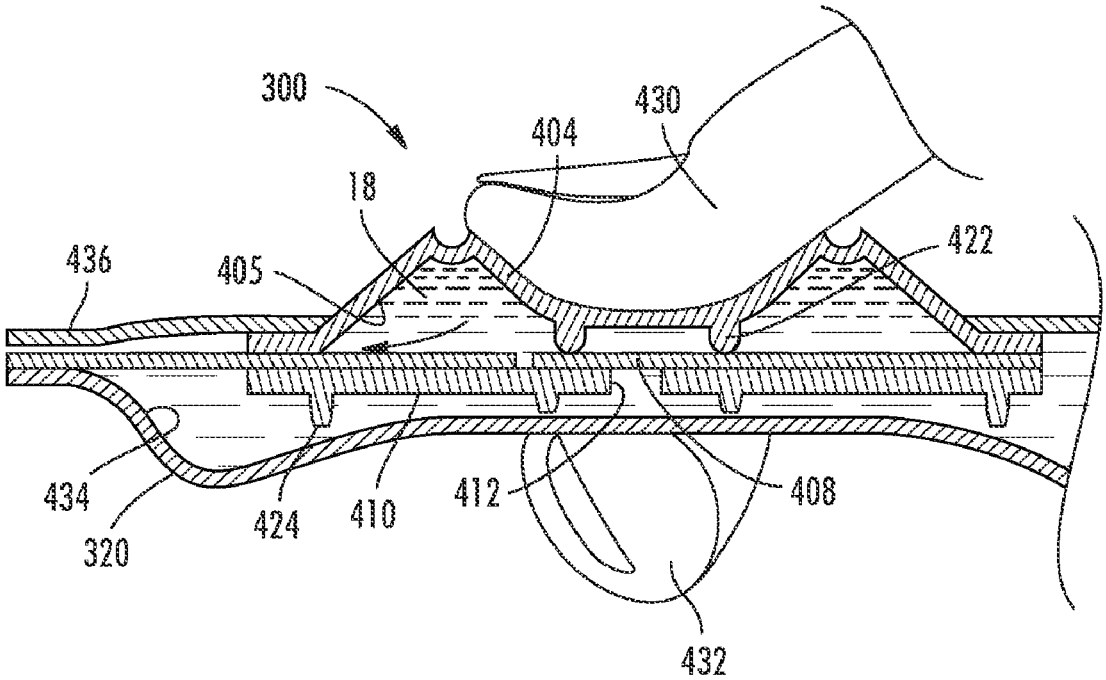
FIG. 5 is a cross sectional view of an alternate embodiment dispensing pump of the invention.

Turning now to FIG. 5, details are shown of an alternate metering pump 300 that includes the improved valving of the present invention that prevents inadvertent or accidental dispensing of fluid 22, 24 even when pressure is placed on the pump 300 or fluid reservoirs 21, 23. In this embodiment of the pump 300 of the present invention, the base plate 410, through which the flow through aperture 412 passes, is preferably slightly convex, although it may be flat, if desired. Resting above the aperture 412 and within the cavity 405 of the dome is a flapper valve 408 of preferably thin film construction. It is possible that this flapper valve 408 be configured of a normally open condition but also may be configured to lie flat when at rest. As long as the plate 410 with the aperture remains convex, the flapper valve 408 does not seal against the aperture 412 such that any inadvertent contact with the flexible dome pump housing 404 does not result in the dispensing of the product. Instead, since the flapper valve 408 is open, liquid product residing inside the cavity 405 of the flexible pump housing 404 will tend to simply flow back through the inlet aperture 412 to the reservoir within the storage container itself, as indicated by the arrow, rather than flow undesirably out through the exit valve to outside of the pump 300. In use, if a person has the fluid dispenser in their pocket or purse and pressure is accidentally or unintentionally placed on the flexible housing 404 of the pump 300, liquid will not flow outside the dispenser thereby preventing a mess from being made due to unintentionally dispensed product.

FIG. 5 illustrates intentional dispensing of fluid 22, 24. When it is desired to actually dispense the liquid product 22, 24, the user's thumb 430 can depress the flexible dome 404 and the user's index finger 432 can invert the base plate 410 from convex to concave, by application of force against the stand-off legs 424, such that flexible dome 404, with the assistance of the stand-off legs 422 under the flexible dome, securely seals and provides a positive lock of the flapper valve 408 over and about the aperture 412 thereby closing the liquid flow passage back into the reservoir 434 of the second fluid reservoir 320. It is also possible that the base plate 410 is concave and then is inverted to a convex configuration. Other fingers of the user may be used to carry out this operation. Thus, the only path for the liquid 302 contained within the cavity 405 of dome 404 is to exit through the one-way outlet valve 436 for intended dispensing of the product, as indicated by the arrows.

In summary, this invention offers many advantages over the prior art by allowing the user flexibility in maintaining two fluid materials as separate components until just prior to use and application.

It would be appreciated by those skilled in the art that various changes and modifications can be made to the illustrated embodiments without departing from the spirit of the present invention. All such modifications and changes are intended to be covered by the appended claims.

What is claimed:

1. A fluid dispensing device, comprising:

a flexible pouch having a plurality of fluid reservoirs;

a plurality of metered dispensing pumps, each of the plurality of metered dispensing pumps in fluid communication with a respective one of the plurality of fluid reservoirs, configured to output a measured amount of fluid from the respective one of the plurality of fluid reservoirs, and comprising:

a hollow flexible button having an inner cavity, the hollow flexible button being distortable from a first position to a second position and automatically returnable substantially to the first position, the inner cavity of the hollow flexible button attached to an inlet port and an outlet port, the inlet port being in fluid communication with the respective one of the plurality of fluid reservoirs, the outlet port being in fluid communication with an exterior of the respective one of the plurality of fluid reservoirs, the hollow flexible button being configured to draw fluid from the fluid reservoir through the inlet port and into the inner cavity when the hollow flexible button is returned from the second position to the first position, the hollow flexible button being further configured to urge fluid from the inner cavity through the exit port when the hollow flexible button is distorted from the first position to the second position;

an exit aperture in fluid connection with each of the outlet ports through which the plurality of metered dispensing pumps deliver the measured amount of fluid from the plurality of fluid reservoirs.

2. The fluid dispensing device of claim 1, wherein for each of the plurality of metered dispensing pumps, the inlet port between the respective one of the plurality of fluid reservoirs and the hollow flexible button is configured to permit unidirectional fluid flow from the respective one of the plurality of fluid reservoirs; and the outlet port, in fluid communication with the hollow flexible button and the exterior of the respective one of the plurality of fluid reservoirs is configured to permit unidirectional fluid flow of a volume of fluid substantially equal to a volume of the inner cavity from the inner cavity upon the hollow flexible button being distorted from the first position to the second position.

3. The fluid dispensing device of claim 1, wherein the fluid in each of the plurality of fluid storage reservoirs is the same type of fluid as in others of the plurality of fluid storage reservoirs.

4. The fluid dispensing device of claim 3, wherein a user can selectively control an amount of fluid dispensed by depressing a selected number of the plurality of metered dispensing pumps.

5. The fluid dispensing device of claim 1, wherein the fluid in each of the plurality of fluid storage reservoirs is a different type of fluid than in others of the plurality of fluid storage reservoirs.

6. The fluid dispensing device of claim 5, wherein the fluid output is mixed as the fluid output passes through the exit aperture.

7. The fluid dispensing device of claim 1, wherein the plurality of metered dispensing pumps are positioned adjacent one another such that a user depresses the plurality of metered dispensing pumps simultaneously.

8. The fluid dispensing device of claim 1, wherein the plurality of fluid storage reservoirs is a first and second fluid storage reservoir and the plurality of metered dispensing pumps is a first and second metered dispensing pump.

9. The fluid dispensing device of claim 8, wherein the fluid in the first fluid reservoir is the same type of fluid as in the second fluid reservoir.

10. The fluid dispensing device of claim 9, wherein a user can selectively control an amount of fluid dispensed by depressing one or both of the first and second metered dispensing pumps.

11. The fluid dispensing device of claim 8, wherein the fluid in the first fluid storage reservoir is a different type of fluid than in the second fluid storage reservoir.

12. The fluid dispensing device of claim 11, wherein the fluid output is mixed as the fluid output passes through the exit aperture.

13. The fluid dispensing device of claim 1, wherein the flexible pouch and the plurality of fluid reservoirs are comprised of at least two film layers.

14. The fluid dispensing device of claim 1, wherein the hollow flexible button is dome shaped.

15. The fluid dispensing device of claim 11, wherein the fluid output is mixed as the fluid output passes through the exit aperture.

16. A fluid dispensing device, comprising:

a flexible main body comprising at least two film layers, the at least two film layers further forming a plurality of fluid reservoirs;

a plurality of fluid conduits in the flexible main body, each of the plurality of fluid conduits extending from one of the plurality of fluid reservoirs to allow metered dispensing of fluid within the plurality of fluid reservoirs through a plurality of metered dispensing pumps attached to the plurality of fluid conduits;

each of the plurality of metered dispensing pumps comprising;

a hollow flexible button having an inner cavity;

the hollow flexible button distortable from a first position to a second position and automatically returnable substantially to the first position;

the inner cavity of the hollow flexible button in fluid communication to an intake port and an exit port;

the intake port also in fluid communication with the fluid conduit of the respective metered dispensing pump;

the exit port also in fluid communication with an exterior of the metered dispensing pumps respective fluid reservoir;

the flexible pump housing being configured to draw fluid from the fluid reservoir through the intake port and into the inner cavity when the hollow flexible button is returned from the second position to the first position; and the flexible pump housing being further configured to urge fluid from the inner cavity through the exit port when the hollow flexible button is distorted from the first position to the second position; and an exit aperture in fluid connection with each of the exit ports through which the plurality of metered dispensing pumps deliver the measured amount of fluid from the plurality of fluid reservoirs.

17. The fluid dispensing device of claim 16, wherein the fluid in each of the plurality of fluid storage reservoirs is the same type of fluid as in others of the plurality of fluid storage reservoirs.

18. The fluid dispensing device of claim 16, wherein the fluid in each of the plurality of fluid storage reservoirs is a different type of fluid than in others of the plurality of fluid storage reservoirs.

19. The fluid dispensing device of claim 18, wherein the fluid output is mixed as the fluid output passes through the exit aperture.

20. The fluid dispensing device of claim 16, wherein the plurality of metered dispensing pumps are positioned adjacent one another such that a user depresses the plurality of metered dispensing pumps simultaneously.

21. The fluid dispensing device of claim 20, wherein the fluid in the first and second fluid reservoirs is the same type of fluid.

22. The fluid dispensing device of claim 21, wherein the fluid in the first and second fluid storage reservoirs is a different type of fluid.

23. The fluid dispensing device of claim 16, wherein the hollow flexible button is dome shaped.

24. The fluid dispensing device of claim 16, wherein the inlet port and the outlet port are made of a flexible material.

25. The fluid dispensing device of claim 16, wherein the hollow flexible button, the inlet port, and the outlet port are made of the same type of flexible material.

26. The fluid dispensing device of claim 16, wherein all the the flexible main body and the plurality of metered dispensing pumps are made of the same type of flexible material.

* * * * *